US007182827B2

(12) United States Patent
Davis et al.

(10) Patent No.: US 7,182,827 B2
(45) Date of Patent: Feb. 27, 2007

(54) ROTARY HEAT SEALING DEVICE AND METHOD

(75) Inventors: Carl James Davis, Corinth, MS (US); Joseph Richard Zeeben, Michie, TN (US); Robert B. Davidovich, Corinth, MS (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/627,539

(22) Filed: Jul. 25, 2003

(65) Prior Publication Data

US 2005/0016664 A1 Jan. 27, 2005

(51) Int. Cl.
*B29C 63/06* (2006.01)
*B29C 65/24* (2006.01)
*B32B 37/06* (2006.01)

(52) U.S. Cl. ..... 156/187; 156/450; 156/582; 156/583.1

(58) Field of Classification Search ..... 156/187, 156/450, 582, 583.1; 242/580, 583
See application file for complete search history.

(56) References Cited

U.S. PATENT DOCUMENTS

| | | | | |
|---|---|---|---|---|
| 3,044,532 A | | 7/1962 | Ghisoni | |
| 3,172,612 A | | 3/1965 | Besserdich | |
| 3,735,551 A | | 5/1973 | Pratt | |
| 3,935,057 A | | 1/1976 | Gray | |
| 3,978,185 A | | 8/1976 | Buntin et al. | |
| 4,041,203 A | | 8/1977 | Brock et al. | |
| 4,213,031 A | * | 7/1980 | Farber | 219/244 |
| 4,340,563 A | | 7/1982 | Appel et al. | |
| 4,430,844 A | | 2/1984 | James | |
| 4,490,962 A | | 1/1985 | Weis et al. | |
| 4,617,781 A | | 10/1986 | Ingersoll et al. | |
| 4,717,372 A | * | 1/1988 | Herrington | 493/193 |
| 4,881,358 A | | 11/1989 | Berg | |
| 4,881,931 A | | 11/1989 | Buchman | |
| 5,240,534 A | * | 8/1993 | Tokita et al. | 156/157 |
| 5,709,761 A | * | 1/1998 | Tajima et al. | 156/159 |
| 5,791,125 A | | 8/1998 | Kallner | |
| 5,935,379 A | | 8/1999 | Frantz et al. | |
| 6,358,356 B1 | * | 3/2002 | Bradshaw et al. | 156/320 |

FOREIGN PATENT DOCUMENTS

| | | |
|---|---|---|
| DE | 3130631 | 2/1983 |
| EP | 0521532 A | 7/1993 |

* cited by examiner

*Primary Examiner*—Mark A. Osele
(74) *Attorney, Agent, or Firm*—Nathan P. Hendon; Richard M. Shane

(57) ABSTRACT

The present invention is directed to the welding of a trailing sheet tail on a roll of sheet material to an underlying layer of the sheet material on the roll to form a finished roll product ready for packaging. A device for effecting the welding comprises a thermally conductive, heat sealing disk mounted for rotation about an axis, and a heating element for heating an inner portion of the disk so as to cause thermal conduction through an outer portion of the disk towards an outer peripheral surface thereof. The heat sealing disk is mounted for engagement with the outer surface of the trailing sheet tail to weld this tail to the underlying layer of sheet material on the roll.

26 Claims, 4 Drawing Sheets

ROTARY HEAT SEALING DEVICE AND METHOD

BACKGROUND OF THE INVENTION

The present invention relates to a device and a method for forming a heat seal between two layers of sheet material. More specifically, the invention relates to the welding of a trailing sheet tail on a roll of sheet material to an underlying layer of sheet material on the roll to form a finished roll product ready for packaging.

Sheet material converted from base rolls into roll product in winder lines generally is wound to a selected diameter and then cut to form a sheet material roll. One of the problems inherent in the production of sheet material rolls is that the sheet web, once cut, forms a trailing sheet tail which has to be bonded to an underlying layer of sheet material to form a finished roll product ready for packaging. If the trailing sheet tail is not properly bonded to the roll, it becomes unfurled or folded over, and may even unwind to present a loose end. Apart from interfering with in-plant handling of the roll, this leads to problems with wrapping and can result in machine downtime. Furthermore, where a clear poly-wrap is used to wrap the roll, the defects are visible through the wrapping, and this detracts from the appearance of the finished product.

Attempts have been made to fasten the tails of sheet material rolls with glue or a similar bonding agent. For example, U.S. Pat. No. 3,044,532 to Ghisoni discloses a device in which a roll of sheet material carried on a conveyor is unwound slightly to expose the free end of the tail, and after application of a glue to the underside of the free end, is rewound to adhere the tail to the roll. In U.S. Pat. No. 3,172,612 to Besserdich, thermoplastic adhesive is applied in a pattern to the underside of the free end of the roll, the free end is rolled against the body of the roll, and a heated, rotating press roll is pressed against the outside of the free end to make the thermoplastic tacky and secure the free end to the roll. Although the use of glue or a similar bonding agent is suitable for certain applications, glue can stain sheet material imparting an unattractive appearance to the roll. Furthermore, glue tends to soak through multiple layers of the sheet material on a roll, and unless the glue is self-releasing and effective for only a limited time after application, the roll is difficult to unwind without tearing and wasting part of the roll. Also, where various different types of sheet materials are converted from base rolls into roll product on the same winder line, a glue which is suitable for some of the sheet materials may not be suitable for others, and often it is not cost-effective to employ two or more glue systems, or to utilize a grade of glue that is effective on all of the sheet materials.

In the art of packaging, it is known to use heat seals for bonding together overlapping sheets of plastic film. One apparatus for producing such a heat seal is disclosed in U.S. Pat. No. 5,935,379 to Frantz et al. This apparatus includes a plurality of rotatable sealing wheels and bearing disks which co-operate with one another on opposed sides of two overlapping edges of a plastic film to form heat seals in the film. This type of heat sealer requires access to the layers of plastic film from opposed sides thereof, and therefore is limited to applications where film layers are accessible from both sides.

U.S. Pat. No. 5,791,125 to Kallner discloses a rotary heat sealer for thermally sealing overlapping film layers wrapped about a load by engaging the outer surface of the outer film layer. The heat sealer in this disclosure includes heat sealing disks which are resiliently mounted to a rotatable shaft and which have peripherally disposed heating elements for engaging overlapping film layers wrapped about the load to thermally seal the film layers together. The heat sealing disks are hollow and contain coil springs for effecting the resilient mounting of the disks to the rotatable shaft. Although this apparatus allows for bonding from one side only of the overlapping film layers, it includes numerous design components and is relatively complex in construction. Furthermore, since the heating elements are positioned on the periphery of the disks, the capacity of the disks to store heat energy is limited, and hence this apparatus is restricted to relatively slow-speed wrapping applications. Apart from this, the physical dimensions and characteristics of commercially available heaters for performing the heat seal limit the bond width and the types of bond patterns achievable.

There remains a need in the art for a device and a method for effecting a heat seal between the trailing sheet tail of a roll of sheet material and an underlying layer of sheet material on the roll by engaging a rotary heat sealing disk with the outer surface of the trailing sheet tail.

What is also needed is a heat sealing device having a rotary heat sealing disk which can store sufficient heat energy to sustain continuous sealing of the trailing sheet tail to the roll of sheet material, in-line with product flow, without affecting continuous production speeds.

There is also a need in the art for a device for bonding various different types of sheet material tails to underlying layers of sheet material on the same winder line.

Furthermore, there remains a need for a heat sealing device which exhibits flexibility with regard to the bond width of the heat seal and/or the types of bond patterns achievable on the heat seal.

SUMMARY OF THE INVENTION

The present invention provides a rotary heat sealing device having a thermally conductive, heat sealing disk mounted for rotation about an axis, and a heating element for heating an inner portion of the disk so as to cause thermal conduction through an outer portion of the disk towards an outer peripheral surface thereof. The heat sealing disk is mounted for engagement with the outer surface of the trailing sheet tail of a roll of sheet material to weld the tail to an underlying layer of sheet material on the roll.

The heating element may be located adjacent the inner portion of the disk, in which case it may be fixed to a support. Alternatively, the heating element may be fixed to the heat sealing disk, or it may form at least a part of the disk.

Desirably, the heat sealing disk defines a plurality of spaced teeth along the outer periphery thereof, and the outer portion of the disk tapers inwardly towards the outer peripheral surface.

In a particularly desired arrangement, the rotary heat sealing device is resiliently supported in cantilever, floating fashion. Typically, the resilient supporting of the rotary heat sealing device is adjustable.

A thermostat may be provided for regulating the temperature at the outer peripheral surface of the heat sealing disk. The thermostat may be arranged to maintain the temperature at the outer peripheral surface between a range of predetermined temperatures for selected conditions. For example, the temperature may range between about 280° F. and about 400° F. for a heat sealing disk having a mass between about 3.5 pounds and about 10.2 pounds, and for roll product having a conveyor speed of between about 60 feet per minute and about 135 feet per minute, a roll diameter between about 5 inches and about 17 inches, and a material mass between about 2.0 ounces per square yard and about 2.5 ounces per square yard.

The heat sealing device may further comprise control means for controlling the conveyance of rolls of sheet material to the heat sealing disk. The control means may include a sensor for sensing the roll product, a thermometer for determining the temperature at the outer peripheral surface of the heat sealing disk, processing means for receiving data from the sensor and the thermometer, for processing the data, and for sending commands to a mechanism for adjusting the rate of conveyance of the roll product to the rotary heat sealing device.

The invention also provides a method of welding a trailing sheet tail on a roll of sheet material to an underlying layer of the sheet material on the roll. The method comprises mounting a thermally conductive, heat sealing disk for rotation about an axis, heating an inner portion of the disk so as to cause thermal conduction through an outer portion of the disk towards an outer peripheral surface thereof, and engaging the heat sealing disk with the outer surface of the trailing sheet tail of the roll of sheet material to weld the tail to the underlying layer of sheet material on the roll.

Desirably, the heat sealing disk is mounted above a conveyor belt for conveying rolls of sheet material one behind the other, and the method comprises sequentially engaging the heat sealing disk with the trailing sheet tail on each roll of sheet material. In this embodiment, the method may comprise controlling the conveyance of the rolls of sheet material to the heat sealing disk to ensure that the outer peripheral surface of the disk remains within a range of predetermined, operable temperatures.

The broad scope of the applicability of the present invention will become apparent to those of skill in the art from the details given below. The detailed description of the invention is given by way of example only, and various modifications within the scope of the invention will be apparent to those of skill in the art.

DEFINITIONS

As used herein, the term "disk" means a generally disk-shaped element which may include a central opening and which may include formations along a generally circular outer peripheral surface thereof. This term is not intended to be interpreted in a narrow sense, i.e. restricted to a flat thin circular object.

As used herein, the term "outer peripheral surface" in relation to "disk" means the circular or generally circular, circumferential edge surface of the disk.

As used herein, the term "comprising" is intended to be inclusive or open-ended, and is not intended to exclude additional elements or method steps which do not prevent operation of the invention.

DETAILED DESCRIPTION OF THE INVENTION

Figure 1:
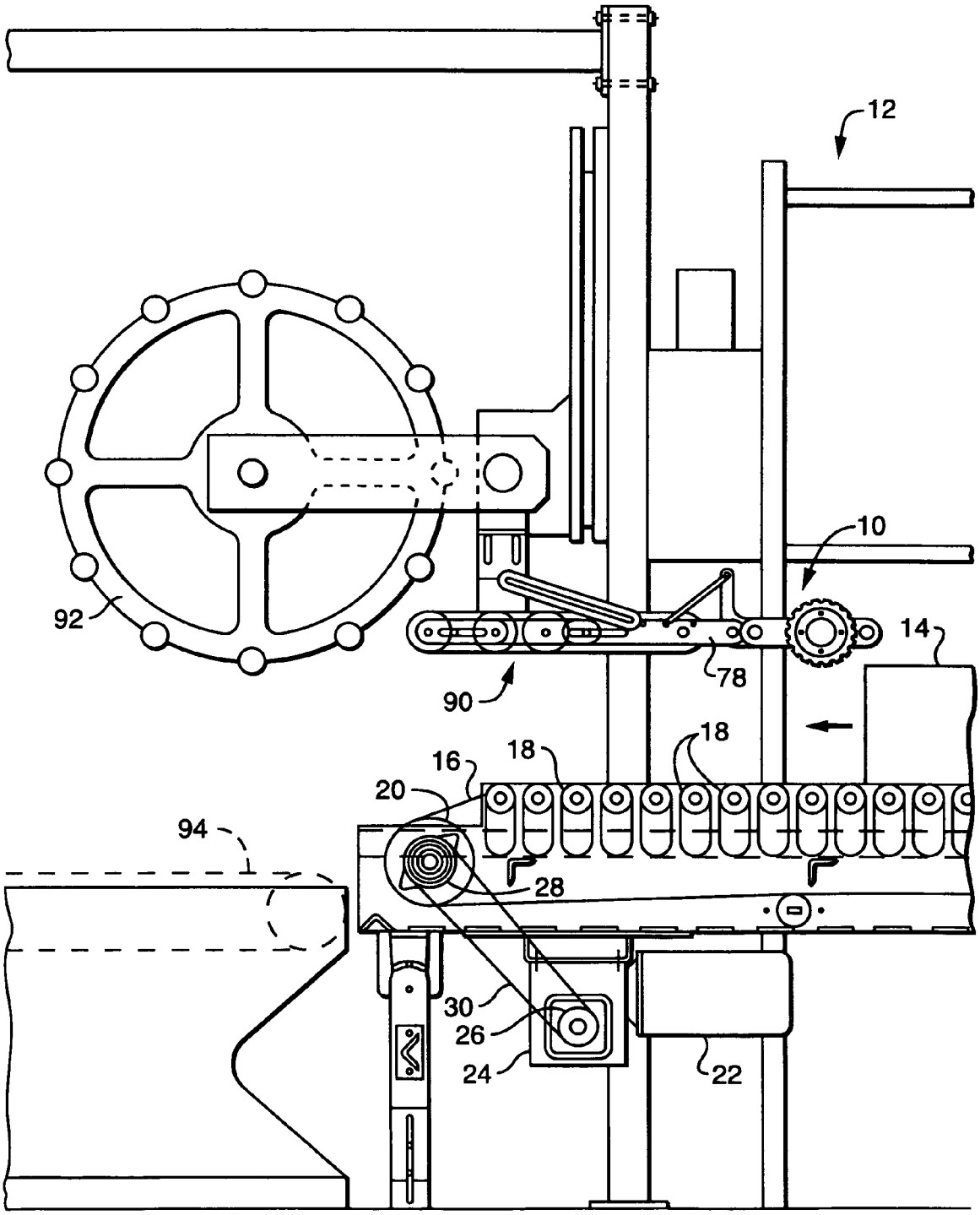
FIG. 1 is a side view, partially in cross-section, of a portion of a winder line for producing finished rolls of sheet material, incorporating a rotary heat sealing device according to one embodiment of the present invention.

Referring to FIG. 1, a rotary heat sealing device 10 according to one embodiment of the present invention is incorporated into a winder line 12 (only a portion of which is illustrated in FIG. 1) for producing finished rolls of sheet material, such as, for example, industrial wipers. The invention may be used with a wide variety of different types of sheet materials and is not limited to industrial wipers. Examples of some sheet materials which may be used include those formed from thermoplastic polymers, including, but not limited to, polyolefins such as polypropylene and polyethylene, polyamides, polyesters such as polyethylene terephthalate, thermoplastic elastomers such as polyurethanes, and so forth. Processes used to make these sheet materials include, but are not limited to, meltblowing, spunbonding, air-forming, wet-forming, carding, and so forth. Exemplary nonwoven thermoplastic materials are described in patents such as U.S. Pat. Nos. 3,978,185 to Buntin et al., 4,041,203 to Brock et al., and 4,340,563 to Appel, et al., which are incorporated herein by reference in their entirety.
.

Typically, the winder line 12 converts various pulp and/or nonwoven-based sheet materials from base rolls into roll product having a finished diameter in the range of about 5 inches to about 17 inches. Roll product 14 exiting a wind-up section of the winder line 12 is deposited onto a conveyor belt 16 leading to the rotary heat sealing device 10. The roll product 14 has a loose trailing sheet tail which is bonded to an underlying layer of sheet material by the heat sealing device 10 to form a finished roll ready for packaging.

The conveyor belt 16 runs over a plurality of conveyor idlers 18 which are inclined to form a generally V-shaped channel for the belt. The rolls 14 are carried lengthwise on the belt 16 and engage the heat sealing device 10 in a manner which is described in more detail below. The conveyor belt 16 is driven by a drive roller 20 which is connected to an electric motor 22 via a gearbox 24, pulleys 26 and 28, and a drive belt 30.

Figure 2:
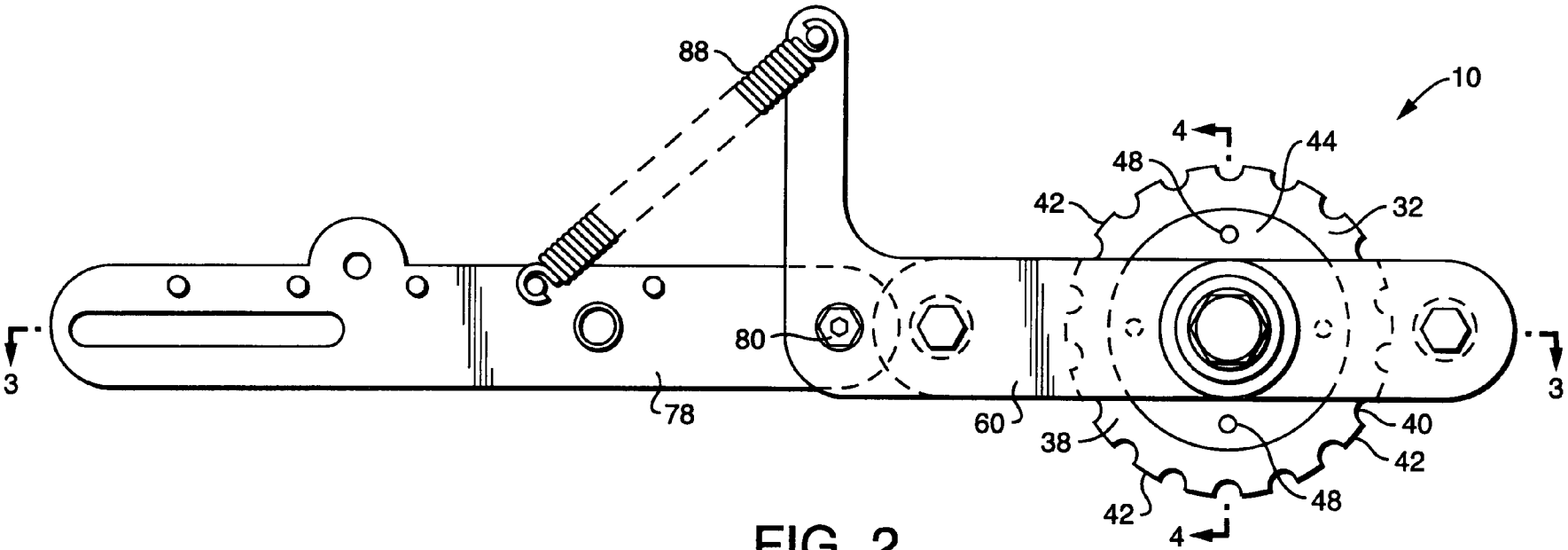
FIG. 2 is a side view of the rotary heat sealing device of the invention.
Figure 3:
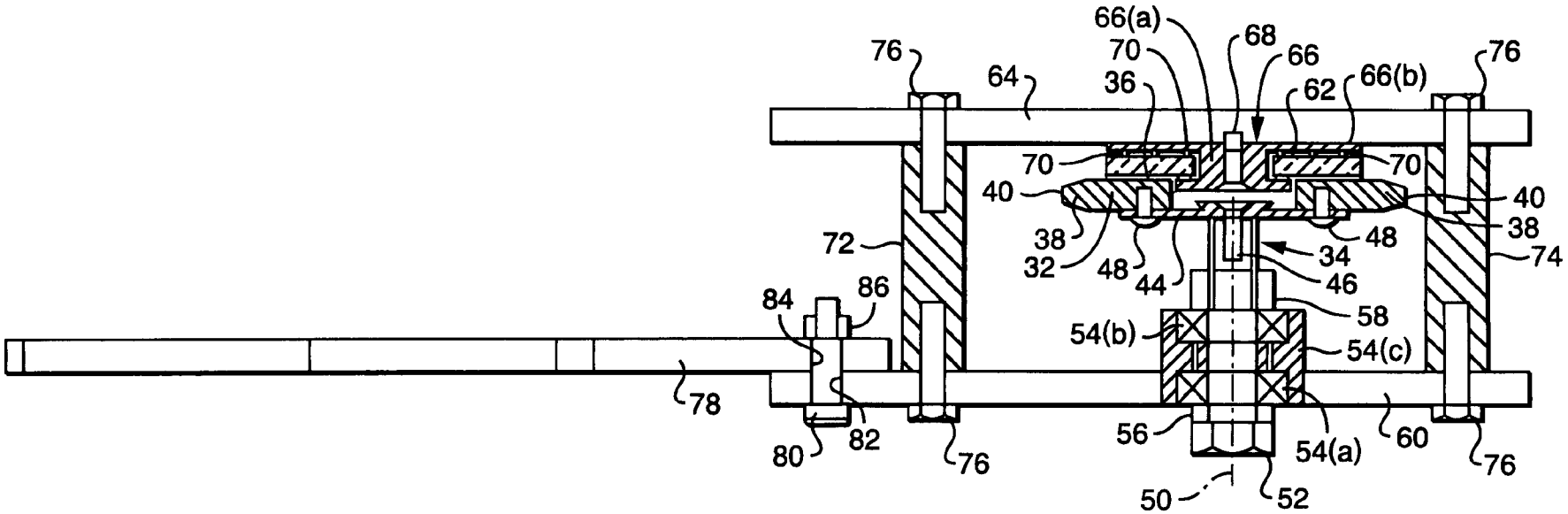
FIG. 3 is a cross-sectional view along the line 3—3 in FIG. 2.
Figure 4:
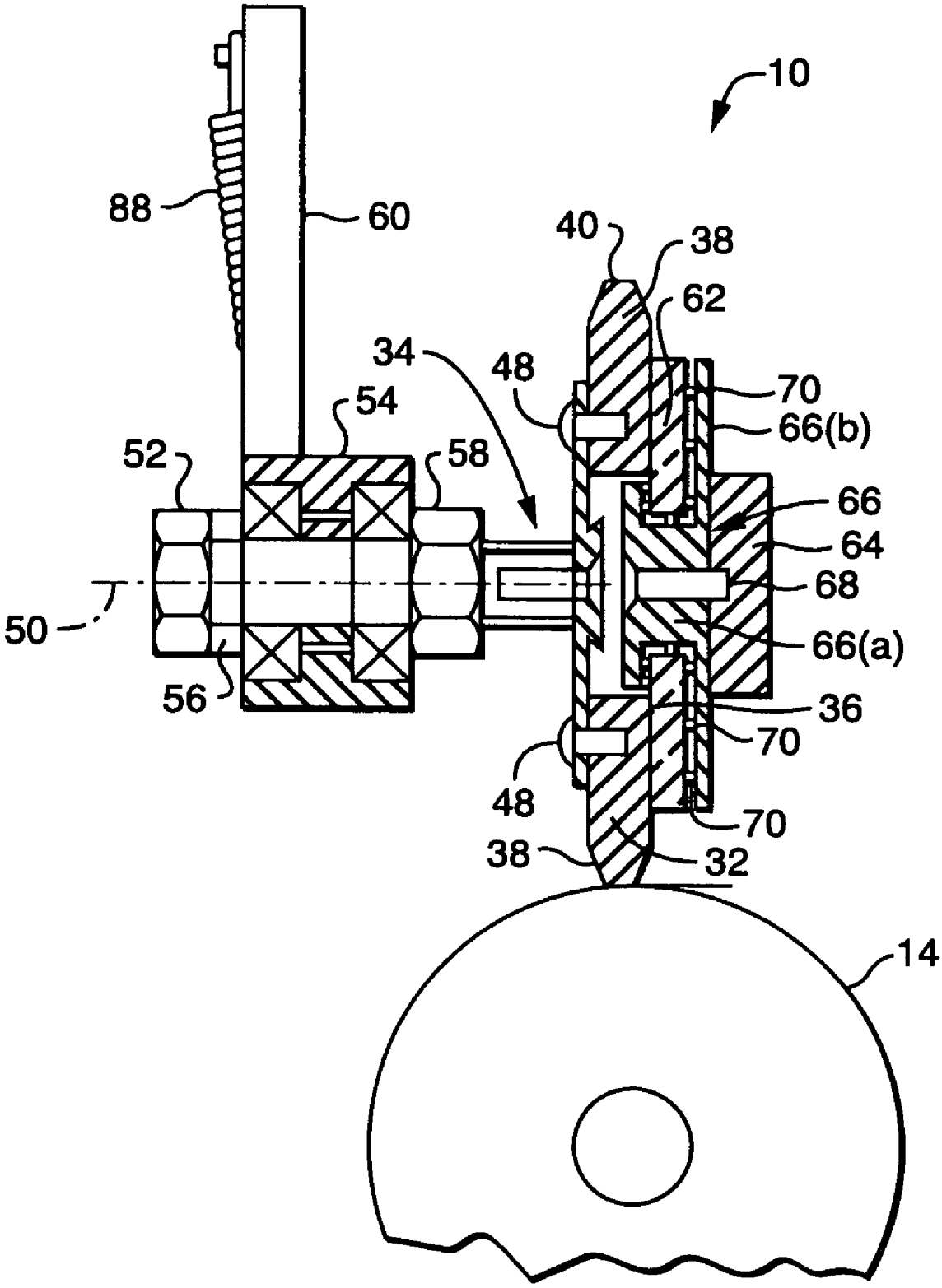
FIG. 4 is a cross-sectional view along the line 4—4 in FIG. 2.

With reference to FIGS. 2 to 4, the heat sealing device 10 comprises a thermally conductive, heat sealing disk 32 which is mounted for rotation on an axle 34. In the illustrated embodiment, the disk 32 is formed from aluminum, and hence is relatively lightweight and a relatively good conductor of heat. The heat sealing disk includes an inner portion 36, and an outer portion 38 which tapers inwardly towards an outer peripheral surface 40 defining a plurality of spaced teeth 42. The disk 32 is connected to the axle 34 by an insulator 44 which is fixed to the axle 34 with a flat head screw 46 and to the disk 32 with four button head screws 48. The insulator 44 is formed from an insulating material such as GAROLITE® 30 high-temperature insulation board, which is available from Mc-Master-Carr having an office in Atlanta, Ga. With particular reference to FIGS. 3 and 4, the axle 34 is rotatable about an axis 50 and comprises a bolt 52 mounted through bearings 54(*a*) and 54(*b*) with a washer 56 and a nut 58. The bearings 54(*a*) and 54(*b*) are press-fitted into a bearing sleeve 54(*c*) which is welded to a support plate 60 with welds (not shown).

A circular heating element 62 is fixed to a support plate 64 by an insulator 66 so as to locate adjacent the inner portion 36 of the heat sealing disk 32. The insulator 66 is also formed from an insulating material such as GAROLITE® 30 high-temperature insulation board. A flat head screw 68 secures an inner section 66(*a*) and a separate outer section 66(*b*) of the insulator 66 to the support plate 64, and the heating element 62 is held between the inner and outer sections of the insulator 66 by wire spacers 70, as shown. In this embodiment of the invention, the heating element 62 comprises a CHROMALOX® heating element, available from Chromalox, Inc. having an office in Pittsburgh, Pa., and is connected to the positive and negative terminals of a power supply (not shown).

Steel spacers 72 and 74 are connected to the support plates 60 and 64 with bolts 76 and are sized to correctly position the heating element 62 adjacent the heat sealing disk 32. The support plate 60 is pivotally connected to a support arm 78 with a shoulder bolt 80 which extends through slightly oversized holes 82 and 84 and which is locked to the support plate and support arm with a nut 86. A coil spring 88 restrains downward pivotal displacement of the support plate 60 relative to the support arm 78, and supports the heat sealing device 10 in cantilever, floating fashion.

Referring back to FIG. 1, the support arm 78 is connected to an adjustable support arrangement designated generally with the reference numeral 90 which is suspended from part of the supporting structure of the winder line 12. The support arrangement 90 is adjustable to raise and lower the rotary heat sealing device 10 relative to the conveyor belt 16, or to displace the device 10 laterally with respect to the belt 16, thereby to accommodate rolls 14 with different diameters.

Downstream of the conveyor belt 16 an overhead wheel 92 is arranged to knock down the leading end of a roll 14 leaving the conveyor belt 16 so as to separate the roll 14 from an adjacent roll on the belt 16 as the roll is transferred to a conveyor belt 94 leading to a wrapping station (not illustrated).

In practice, electrical current is passed through the heating element 62 to heat the adjacent inner portion 36 of the heat sealing disk 32, and the heated inner portion 36 conducts heat radially into the outer portion 38 of the disk 32, which in turn conducts heat to the outer peripheral surface 40 of the disk. In this way, the entire disk 32 is heated and stores heat energy along its radius. A thermostat (not illustrated) regulates the temperature at the outer peripheral surface 40 to ensure that this surface remains within a predetermined temperature range. This is important if effective welding is to be achieved because, for predefined conditions, if the temperature at the surface 40 is below a predetermined minimum temperature, the disk 32 will not effect welding of the trailing sheet tail to the underlying layer of sheet material on the roll. On the other hand, if the temperature at the surface 40 is above a predetermined maximum temperature, the disk 32 will weld together multiple layers of the sheet material, thereby damaging a number of layers of sheet material on the roll unnecessarily. For polypropylene-based sheet material, such as, for example, polypropylene-based KIMTEX® meltblown nonwoven material, which is available from Kimberly-Clark Corporation having an office in Neenah, Wis., if the roll diameter is between about 5 inches and about 17 inches and the material mass is between about 2.0 ounces per square yard and about 2.5 ounces per square yard, the temperature of the outer peripheral surface 40 of the disk 32 typically will range between about 280° F. and about 400° F. for effective, continuous bonding using a heat sealing disk having a mass between about 3.5 pounds and about 10.2 pounds, and with conveyor speeds between about 60 feet per minute and about 135 feet per minute. It should be appreciated that the temperature of the outer peripheral surface of the heat sealing disk 32 will vary depending on the application, and that the ranges provided above are merely by way of example.

Once the temperature at the outer peripheral surface 40 reaches the predetermined temperature, rolls 14 discharged from the wind-up section of the winder line 12 are directed along the conveyor belt 16 to the rotary heat sealing device 10. The support arrangement 90 upon which the device 10 floats is adjusted so that the disk 32 applies a suitable pressure to the rolls 14 as these rolls pass below the device, in use. The rolls 14 are orientated on the conveyor belt 16 in the manner illustrated in FIG. 4 so that, as each roll passes below the device 10, the heat sealing disk 32 engages the trailing sheet tail at or near the end of this tail to weld the tail to the underlying layer of sheet material on the roll. Upon engaging the trailing sheet tail of each roll 14, the disk 32 is rotated along the length of the roll to form a weld across the entire length of the roll.

The leading end of each roll 14 leaving the conveyor belt 16 is deflected downwardly by the wheel 92, ensuring separation of the roll 14 from the leading end of a roll immediately behind it, and the deflected roll 14 is deposited onto the conveyor belt 94. The roll 14 is then conveyed to a wrapping station (not illustrated) where it is wrapped in a clear poly-wrap.

Control means (not illustrated) may be installed for controlling the conveyance of the rolls 14 to the heat sealing disk 32. Such control means typically would include a sensor for sensing the roll product, a thermometer for determining the temperature at the outer peripheral surface 40 of the heat sealing disk, processing means for receiving data from the sensor and the thermometer, for processing the data, and for sending commands to a mechanism for adjusting the velocity of the conveyor belt 16. The device 10 may also include a secondary heat sealing disk (not shown), in which case the control means would include a mechanism for interchanging the two heat sealing disks to ensure that the outer peripheral surface of the disk in-line with product flow remains within a range of predetermined, operable temperatures.

Instead of the teeth 42 on the heat sealing disk 32, various patterns or formations could be machined into the outer peripheral surface of the disk to create desired final appearances or to yield specific functionality. For example, a logo and/or a trade name could be machined into the disk 32 to provide heat seals incorporating the selected logo and/or trade name. Apart from allowing for flexibility in the patterns or formations which can be carried on the outer edge of the heat sealing disk 32, the aluminum disk allows for flexibility in the selection of a suitable bond width for the heat seal.

It will be appreciated that the outer peripheral surface of the disk 32 could also be smooth, and the outer portion 38 of the disk 32 need not taper inwardly towards the outer peripheral surface 40. It will also be appreciated that the disk 32 could be formed from a thermally conductive material other than aluminum, and could be mounted for rotation in various different ways and on various different frames or support structures.

It will be understood by those of skill in the art that the heating of the inner portion 36 of the heat sealing disk 32 and the consequent conduction of heat energy to the outer peripheral surface 40 results in the heating of the entire disk 32. This allows the disk to store sufficient heat energy along its radius to sustain continuous heat sealing of the trailing sheet tail to the roll of sheet material, in-line with product flow, without affecting continuous production speeds.

It will also be understood that various different types of sheet materials, such as polypropylene nonwoven materials and other nonwoven and thermoplastic materials, can be welded on the same winder line with the heat sealing device of the invention.

Having thus described the invention in detail, it should be apparent to those skilled in the art that various modifications can be made without departing from the scope of the invention as defined in the following claims.

What is claimed is:

1. A rotary heat sealing device for welding a trailing sheet tail on a roll of sheet material to an underlying layer of the sheet material on the roll, the rotary heat sealing device comprising:

a thermally conductive, heat sealing disk mounted for rotation about an axis; and a heating element axially adjacent to the heat sealing disk, for heating an inner portion of the disk so as to cause thermal conduction axially to the heat sealing disk and then radially through the disk toward an outer portion of the disk and towards an outer peripheral surface thereof;

wherein the heat sealing disk is engageable with the outer surface of the trailing sheet tail on the roll of sheet material to weld the tail to the underlying layer of sheet material on the roll.

2. The rotary heat sealing device of claim 1, wherein the heating element is located adjacent the inner portion of the disk.

3. The rotary heat sealing device of claim 2, wherein the heating element is fixed to a support and the heat sealing disk is rotatable adjacent the heating element.

4. The rotary heat sealing device of claim 1, wherein the heating element is fixed to the disk.

5. The rotary heat sealing device of claim 1, wherein the heating element forms at least a part of the disk.

6. The rotary heat sealing device of claim 1, wherein the heat sealing disk defines a plurality of spaced teeth along the outer periphery thereof.

7. The rotary heat sealing device of claim 1, wherein the outer portion of the heat sealing disk tapers inwardly towards the outer peripheral surface thereof.

8. The rotary heat sealing device of claim 1, further comprising resilient support means for supporting the heat sealing disk in cantilever, floating fashion.

9. The rotary heat sealing device of claim 8, wherein the resilient support means is adjustable.

10. The rotary heat sealing device of claim 1, further comprising a thermostat for regulating the temperature at the outer peripheral surface of the heat sealing disk.

11. The rotary heat sealing device of claim 1, further comprising control means for controlling the conveyance of the rolls of sheet material to the heat sealing disk.

12. A rotary heat sealing device for welding a trailing sheet tail on a roll of sheet material to an underlying layer of the sheet material on the roll, the rotary heat sealing device comprising:

a thermally conductive, heat sealing disk mounted for rotation about an axis; and a heating element axially adjacent to the heat sealing disk, for heating an inner portion of the disk so as to cause thermal conduction axially to the heat sealing disk and then radially through the disk toward an outer portion of the disk and towards an outer peripheral surface thereof.

13. The rotary heat sealing device of claim 12, wherein the heating element is located adjacent the inner portion of the disk.

14. The rotary heat sealing device of claim 13, wherein the heating element is fixed to a support and the heat sealing disk is rotatable adjacent the heating element.

15. The rotary heat sealing device of claim 12, wherein the heat sealing disk defines a plurality of spaced teeth along the outer periphery thereof.

16. The rotary heat sealing device of claim 12, wherein the outer portion of the heat sealing disk tapers inwardly towards the outer peripheral surface thereof.

17. The rotary heat sealing device of claim 12, further comprising resilient support means for supporting the heat sealing disk in cantilever, floating fashion.

18. The rotary heat sealing device of claim 17, wherein the resilient support means is adjustable.

19. A method of welding a trailing sheet tail on a roll of sheet material to an underlying layer of the sheet material on the roll, the method comprising:

mounting a thermally conductive, heat sealing disk for rotation about an axis;

heating an inner portion of the disk so as to cause thermal conduction axially to the heat sealing disk and then radially through the disk toward an outer portion of the disk and towards an outer peripheral surface thereof; and engaging the heat sealing disk with the outer surface of the trailing sheet tail of the roll of sheet material to weld the tail to the underlying layer of sheet material on the roll.

20. The method of claim 19, wherein the inner portion of the disk is heated by locating a heating element adjacent the inner portion and heating the heating element.

21. The method of claim 19, wherein the inner portion of the disk is heated by providing a heating element in a central region of the disk and heating the heating element.

22. The method of claim 19, wherein the heat sealing disk defines a plurality of spaced teeth along the outer periphery thereof, and the trailing sheet tail of the roll of sheet material is welded to the underlying layer of sheet material on the roll by engaging the teeth on the heat sealing disk with the outer surface of the trailing sheet tail.

23. The method of claim 19, further comprising resiliently supporting the heat sealing disk in cantilever, floating fashion.

24. The method of claim 19, further comprising regulating the temperature at the outer peripheral surface of the heat sealing disk.

25. The method of claim 19, further comprising mounting the heat sealing disk above a conveyor belt for conveying rolls of sheet material one behind the other, and sequentially engaging the heat sealing disk with the outer surface of the trailing sheet tail on each roll of sheet material.

26. The method of claim 25, further comprising controlling the conveyance of the rolls of sheet material to the heat sealing disk to ensure that the outer peripheral surface of the disk remains within a range of predetermined, operable temperatures.

* * * * *